United States Patent [19]

Laskaris et al.

[11] Patent Number: 4,971,949

[45] Date of Patent: Nov. 20, 1990

[54] ELECTROMAGNETIC LAUNCHER

[75] Inventors: Evangelos T. Laskaris, Schenectady; Madabushi V. K. Chari, Burnt Hills, both of N.Y.

[73] Assignee: General Electric Company, Schenectady, N.Y.

[21] Appl. No.: 369,495

[22] Filed: Jun. 21, 1989

[51] Int. Cl.[5] ..... F41B 6/00; F41F 3/10

[52] U.S. Cl. ..... 505/1; 114/238; 417/417; 505/876; 505/910

[58] Field of Search ..... 89/5, 7, 8; 124/3, 54, 124/56, 58, 71; 114/238, 239, 318, 319; 417/417, 418; 505/876, 910

[56] References Cited

U.S. PATENT DOCUMENTS

| | | | |
|---|---|---|---|
| 581,204 | 4/1897 | Heftye | 417/418 |
| 2,837,971 | 6/1958 | Wosak | 89/5 |
| 4,002,935 | 1/1977 | Brauer | 417/418 |
| 4,432,333 | 2/1984 | Kurherr | 89/8 |
| 4,535,595 | 8/1985 | Keller et al. | 62/3.1 |

OTHER PUBLICATIONS

Beam et al., "Superconductors as Permanent Magnets", Journal of Applied Physics, vol. 33, No. 11, Nov. 1962, pp. 3334–3337.

*Primary Examiner*—Stephen C. Bentley

*Attorney, Agent, or Firm*—William H. Steinberg; James C. Davis, Jr.; Paul R. Webb, II

[57] ABSTRACT

A toroidal circumferentially wound superconducting coil is provided for generating a constant magnetic field with a significant radial field component. A room-temperature resistive coil wound circumferentially and connected to launch activating means is coaxial with the superconductive coil. Interaction of the current in the resistive coil with the radial field component of the superconductive coil produces an axial force on the resistive coil and in turn on the launch activating means. The axial force is controllable in magnitude and direction by controlling the magnitude and direction of the current supplied to the resistive coil.

1 Claim, 9 Drawing Sheets

ELECTROMAGNETIC LAUNCHER

CROSS REFERENCE OF RELATED APPLICATION

The present invention is related to copending application Ser. No. 215,165, filed July 5, 1988, entitled "Superconductive Magnetic Resonance Magnet Without Cryogens" and assigned to the same assignee as the present invention.

BACKGROUND OF THE INVENTION

The present invention relates to an electromagnetic launcher in which a superconductive coil is used for generating a magnetic field to move a plunger to force water behind an object to be launched, such as a torpedo, and eject it from its tube.

In launching torpedoes, the torpedo is ejected from a tube to provide the acceleration to a desired velocity. Once launched, the torpedo propellor, supplied from a power supply in the torpedo, maintains the torpedo speed. Torpedoes are launched using compressed air to drive a plunger which in turn forces a torpedo out of the tube or they are launched using an air driven pump to pump water against the torpedo to drive it from the tube. The use of compressed air makes a characteristic noise during torpedo launching which can be detected.

In submarines, equipment weight, size, and power consumption are important design parameters which have to be kept to a minimum. In addition, a low noise signature of the electrical system operating an electromagnetic launcher is critical as well as a reduced acoustical noise level. Acoustic and electrical noise can provide means by which detection by enemy vessels can occur.

Electromagnetic launchers proposed for use with projectiles have stationary resistive coaxial coils which are powered sequentially by a solid state commutated power supply to propel a moving coil which is DC powered. The power consumption and weight of these devices is quite large because of the high field strength and current density requirements. Fast switching of multiple coils requires a complex solid state power supply.

It is an object of the present invention to provide an electromagnetic launcher which is quiet, has high reliability, and minimum maintenance requirements.

It is a further object of the present invention to provide an electromagnetic launcher which can be retrofit into existing vessels.

It is another object of the present invention to provide an interaction between a magnetic field and a plunger that does not require commutation of a magnetic field and operates with a simple control system.

SUMMARY OF THE INVENTION

In one aspect of the present invention, an electromagnetic launcher is provided having a stationary superconductive coil with a central aperture. A resistive coil is situated coaxially with the superconductive coil and is movable axially relative to the stationary superconductive coil. The movable coil is coupled to launch activating means. A power supply is connected to the resistive coil for providing current of a desired direction and magnitude, so that energization of the resistive coil in the presence of the radial field component of the magnetic field of the superconductive coil creates an axial force on the movable coil, the direction of which is dependent on the current direction in the resistive coil.

In another aspect of the present invention, a superconductive magnet cooled by a two-stage cryocooler for generating a constant magnetic field is provided including a cylindrical vacuum vessel having an axially extending bore therethrough. The vacuum vessel defines an aperture for accepting the cold end of the cryocooler. An epoxy impregnated superconductive coil is situated inside the vacuum vessel coaxial with the bore. A cylindrical support shell is situated in the vacuum vessel with the coil positioned inside and in contact with the inner circumference of one axial end of the shell. The cylindrical shell is supported at the other axial end by the vacuum vessel. The second stage of the cryocooler is in thermal contact with the shell portion surrounding the exterior of the winding. A cylindrical thermal radiation shield encloses the shell portion surrounding the coil and the inner and end portions of said coil. The thermal radiation shield is in thermal contact with and supported by an annular portion of the shell located between the end of the shell supported by the vacuum vessel and the portion of the shell surrounding the superconductive coil.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

DETAILED DESCRIPTION OF THE INVENTION

Figure 1A:
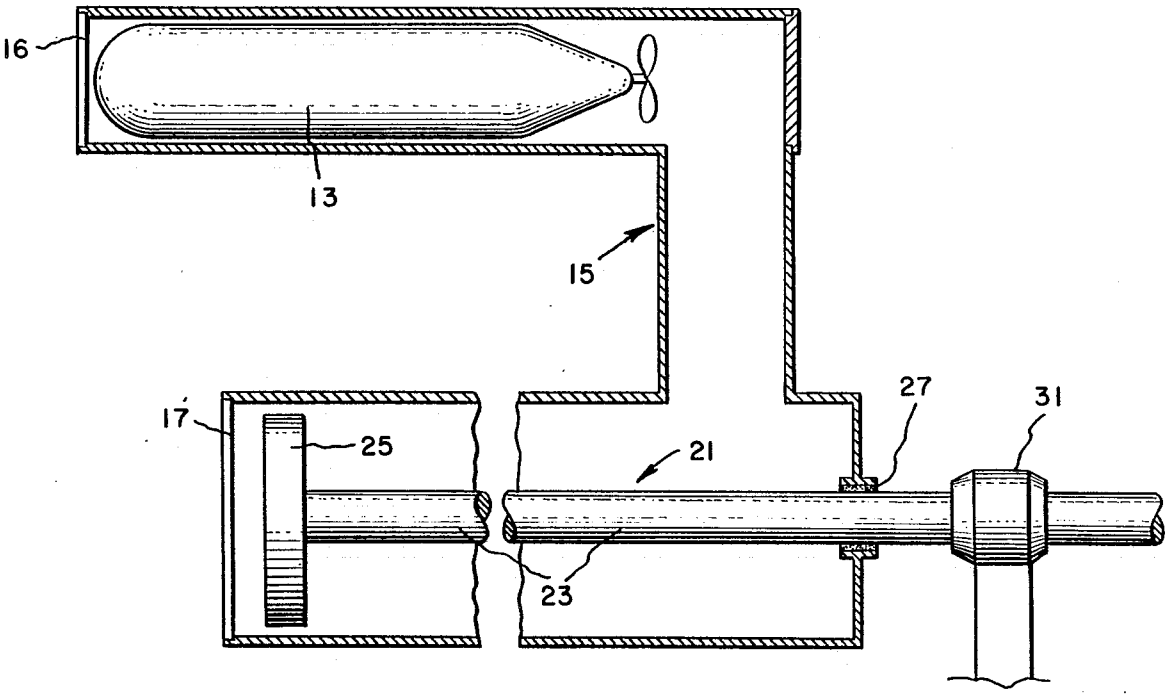
FIGS. 1A and B are a side view partly in section of an electromagnetic torpedo launcher in accordance with one embodiment of the present invention.
Figure 1B:
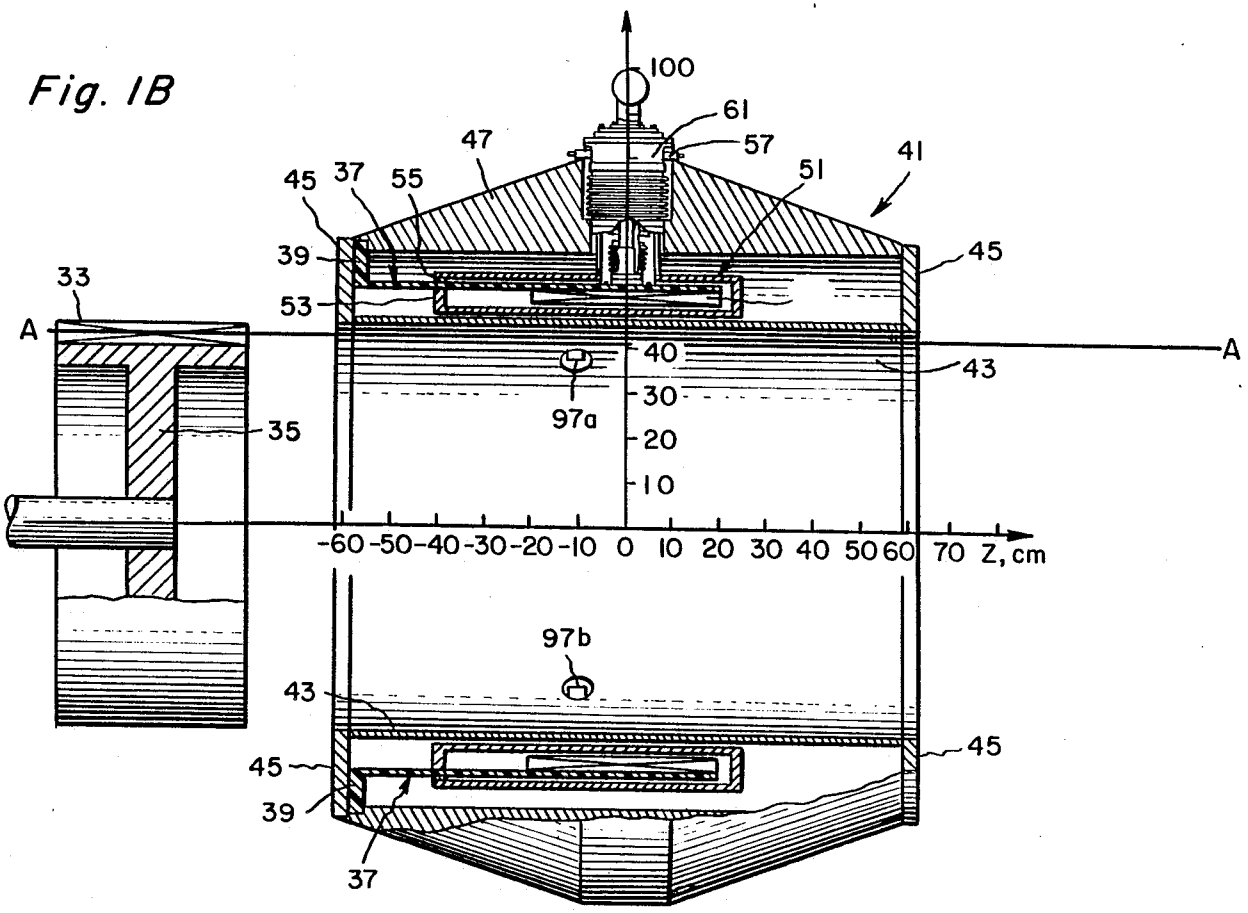

Referring now to the drawing and particularly FIGS. 1A and 1B thereof, an electromagnetic launcher with a single stationary superconducting coil 11 is shown. A torpedo 13 is situated in one end of a tube 15 which is in flow communication at either end 16 and 17 with water outside the tube. A plunger 21, includes a sliding shaft 23 with a piston 25 mounted on one end of the shaft. The shaft 23 extends into tube 15 through a stuffing box 27, which prevents water leakage from the tube. The piston 25 is situated in tube 15. The shaft 23 is supported by linear bearing guide 31. The other end of plunger 23 has a resistive coil 33 mounted on a non-magnetic disc 35 which is secured to shaft 23. The shaft 23 and disc 35 can be fabricated, for example, from stainless steel. The resistive coil 33 can be wound with copper or aluminum wire and is concentric with the shaft 23. A resistive coil rather than a superconductive coil is used for the moving winding since the current in the coil must be controlled to achieve the desired velocity profile during the ejection stroke and also when returning the plunger to initiate another shot. Superconducting coils are limited in how rapidly the current in the coils can be changed without the superconducting coil quenching (losing their superconducting properties). Flexible cables (not shown) are attached to the resistive coil and connected to a power supply shown in FIG. 4 and described hereinafter. The power supply is used to provide current of desired magnitude and direction to the resistive coil during its ejection stroke and return stroke. In the present embodiment the resistive coil 33 has 200,000 ampere turns and a current density of 2,667 amperes/cm.$^2$. The coil 33 has a mean radius of 0.5 meters and a radial height and axial length of $4\times30$ cm.

The stationary superconductive coil 11 has an inner diameter greater than the outer diameter of the resistive coil 33 and is formed by winding niobium tin superconductive wire on a demountable coil form. The winding and coil form are epoxy impregnated and the superconducting coil is removed from the coil form. The coil form is not used in the superconductive magnet. Superconductive wire is preferred over superconductive tape because the wire has filamentary superconductive strands embedded in a copper matrix which are better at limiting AC losses when subjected to time varying fields. A free standing coil avoids any delamination problems from the coil form during operation. The superconductive coil 11 in the present embodiment has 1,000,000 ampere turns with a current density of 16,700 amperes/cm.$^2$. The coil has a calculated peak field of 2.9 Tesla and a mean radius of 0.6 m. The radial height by axial length of the coil is $2\times30$ cm.

The superconductive coil 11 is supported by a thin fiberglass cylindrical support shell 37. The superconductive coil 11 fits inside one end of the shell and is bonded therein using epoxy adhesive, for example. The other end of the fiberglass shell has a circular flanged end 39. The shell 37 is situated inside a cylindrical vacuum envelope 41 having a central bore 43 running axially therethrough. The central bore 43 of the vacuum envelope extends through the inner diameter of the superconductive coil 11. In the present embodiment the vacuum enclosure comprises a bore sleeve 43 fabricated from nonmagnetic material such as stainless steel, a pair of annular end plates 45, and an outer cylindrical portion 47. The end plates 45 and outer cylindrical portion 47 are fabricated from iron to provide magnetic field shielding. The cross-sectional thickness of the outer cylindrical portion is greatest at the axial midplane of the cylindrical portion decreasing in thickness towards both axial ends.

The flanged end of the cylindrical fiberglass shell 39 is situated in a counterbore on one end of the outer cylindrical portion 47 of the vacuum vessel 41. One of the annular end plates 45 captures the flange 39 between the annular end plate 45 and the outer cylindrical portion 47. The cylindrical shell 37 is only supported on one end. A thermal shield 51, surrounds the winding 11 but is spaced away therefrom. The thermal shield 51 is supported at the midpoint on the cylindrical support shell 37 between the flanged end 39 and the end of the coil 11 closest to the flange 39, by an inner and outer ring 53 and 55, respectively, with a portion of the shell 37 situated between the rings. The rings 53 and 55 are bonded to the support shell 37 using epoxy adhesive to ensure good heat transfer between the thermal shield 51 and the support shell. The thermal shield is supported by the rings spaced away from the vacuum vessel 41 and the windings 11. The thermal shield is fabricated from material having high thermal conductivity at low temperatures, such as high purity aluminum or high purity copper.

Figure 2:
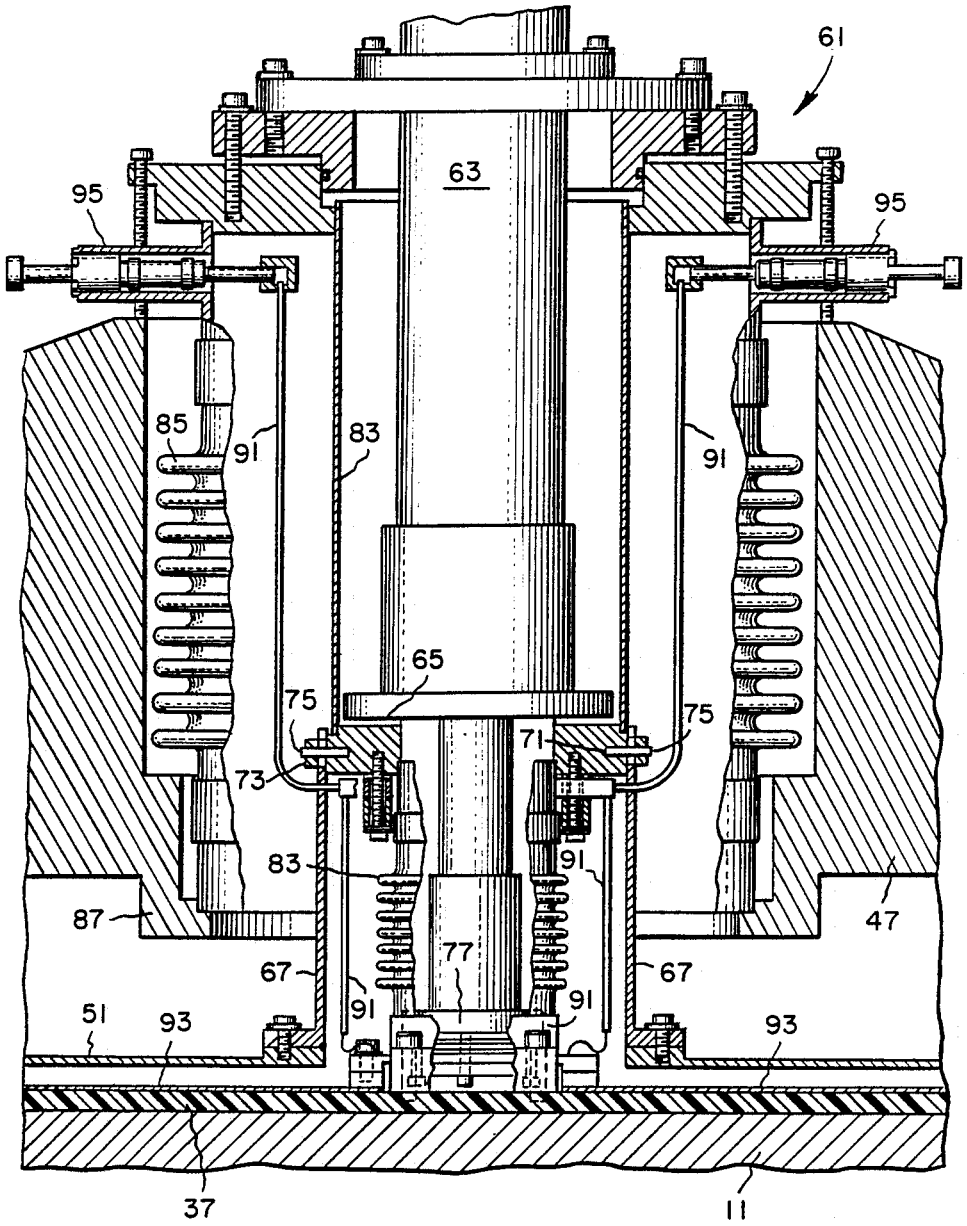
FIG. 2 is a side view with revolved sections of the cryocooler interface cold end of the cryocooler of FIG. 1B.
Figure 3:
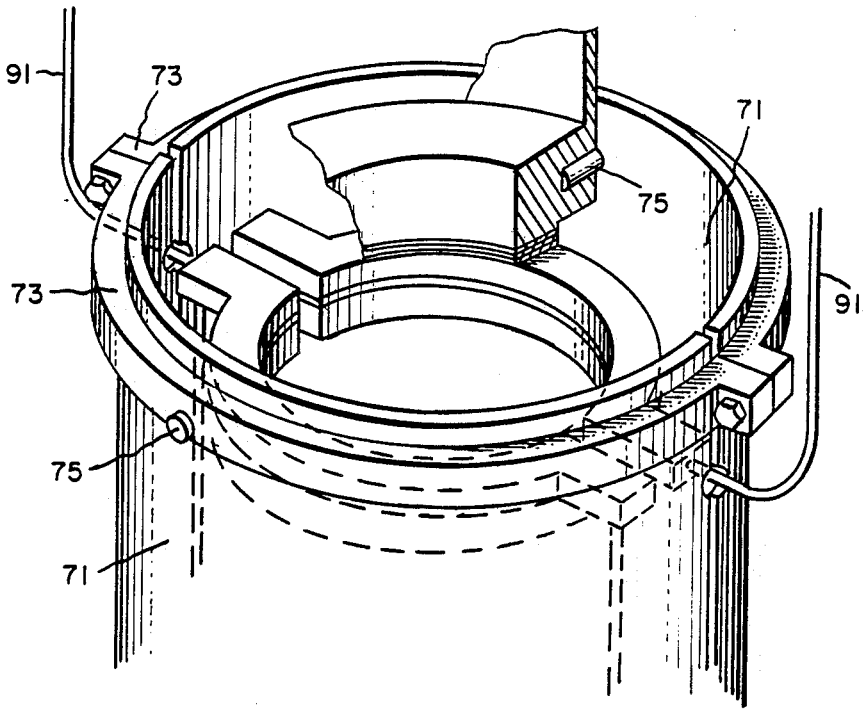
FIG. 3 is an isometric view, partially cut away, of a portion of the cryocooler interface showing the first stage heat exchanger.

The vacuum vessel 41 defines a radially extending aperture 57 in the outer cylindrical vacuum vessel wall located at the axial midplane of the vacuum vessel. An interface 61 for connecting a two-stage crycooler 63 penetrates the vacuum vessel wall and extends into the vacuum vessel. Referring now to FIG. 2, the interface 61 together with the cold end portion of the cryocooler 63 is shown. The interface is similar to the one shown in copending application entitled "Cryocooler Cold Head Interface Receptacle", Ser. No. 348,322, filed May 5, 1989, which is a continuation of Ser. No. 215,114, field July 5, 1988, both assigned to the instant assignee and hereby incorporated by reference. The first stage 65 which is the warmer of the two stages of the cryocooler 63 is thermally coupled to the thermal shield 51 by means of a split copper cylinder 67 which is bolted at one end to the thermal shield and at the other end is soldered to a copper ring 71 which serves as the first stage heat exchanger of the cryocooler interface. A split copper ring 73 which can be seen more clearly in FIG. 3 clamps the ring 71 securely in place. Pins 75 hold the split ring 73 in position during soldering and provide mechanical support. The thermal shield 51 intercepts heat conducted from the vacuum vessel 41 through the support shell 37 where the two rings 53 and 55 of the thermal shield surround the support shell. The second and colder stage 77 of the cryocooler removes heat from the superconductive winding 11. A block of copper 81 which serves as the closed end of an inner sleeve 83 and as the second stage heat exchanger of the cryocooler interface is supported by the shell portion surrounding the winding. The inner sleeve 83 and an outer sleeve 85 seal the vacuum vessel opening and allows the cryocooler to be removed while maintaining the vacuum condition in the vacuum vessel. The outer sleeve 85 is supported by a boss 87 in the vacuum vessel. In the configuration shown in FIGS. 2 and 3, the collar and braid shown in copending application Ser. No. 348,322 for connecting the thermal radiation shield to the first stage interface heat exchanger have been replaced by a split copper cylinder soldered to the first stage heat exchanger to improve thermal conductivity between the first stage heat exchanger and the thermal shield. The flexibility lost because of the removal of the braid is provided by the flexibility of the thermal shield. Other features of the interface and its operation remain unchanged. The cryocooler interface also provides electrical leads 91 to power the superconductive coil. The electrical leads are heat stationed at the first and second stage heat exchangers of the interface. The current is carried in bus bars 93 to the superconductive coil. The leads enter the outer sleeve 85 through vacuum tight current lead feedthroughs 95.

The suspension system of the superconducting coil must be capable of supporting the peak axial electromagnetic load that results from the resistive coil passing through the magnet's bore. For a typical case the force is about 90,000 lbs and is clearly the dominant loading of the suspension system compared to the weight of the magnet winding, about 1000 pounds, and cryocooler interface loading also about 1,000 pounds. Therefore, shock and vibration loading on the windings will be small compared to the electromagnetic load. The fiberglass cylindrical shell in the present embodiment has a 41 inch diameter and a 0.08 inch thickness. The fiberglass support shell 37 of the magnet is subjected to a peak axial stress of ±9 ksi when the resistive coil 33 passes therethrough, which is well below the typical ultimate strength, 50 ksi, which can be achieved with fiberglass composites. Shock and vibration forces will load the magnetic support shell mainly in bending. With a lightweight winding and thermal shield, 1000 lbs. or less, the magnet support shell can withstand shock accelerations well over 1000 g. It is expected therefore, that the magnet will be quite insensitive to shock and vibration loads.

The calculated magnet thermal loads on the first and second stages of the cryocooler are shown in Table 1 below.

TABLE 1

| Source | Cryocooler Thermal Loads First Stage, w | Second Stage, w |
|---|---|---|
| Radiation | 8 | 0.12 |
| Residual Gas Conduction in Vacuum | 1 | 0.06 |
| Cryocooler Interface | 3 | 0.06 |
| Support Shell | 1 | 0.26 |
| Leads | 9 | 1.20 |

A Gifford McMahon cycle two stage cryocooler such as a Balzers UC110 cryocooler manufactured by Balzers, Hudson, New Hampshire, can cool the magnet cartridge, which includes the epoxy impregnated windings and the surrounding portion of the support shell, and can cool the thermal shield to 9.5K and 40K, respectively by direct contact conduction cooling The refrigerated superconductive coil operates without the need of consumable cryogens eliminating the need to store and add liquid helium, liquid nitrogen or other cryogens. Gifford McMahon cycle cryocoolers are rugged and highly reliable. These type refrigerators have low noise characteristics.

Electrical leads and the use of a continuously connected power supply in connection with the superconducting coil are suggested since superconducting joints have not yet been obtained with refrigerated magnets. The losses in the joints, however, are very small and it is estimated that after charging the superconductive coil it would take about six years for the magnet to decay to 95% of its initial field value. The power supply (not shown) could be disconnected during normal operation and reconnected briefly every few months to recharge the coil.

Figure 4:
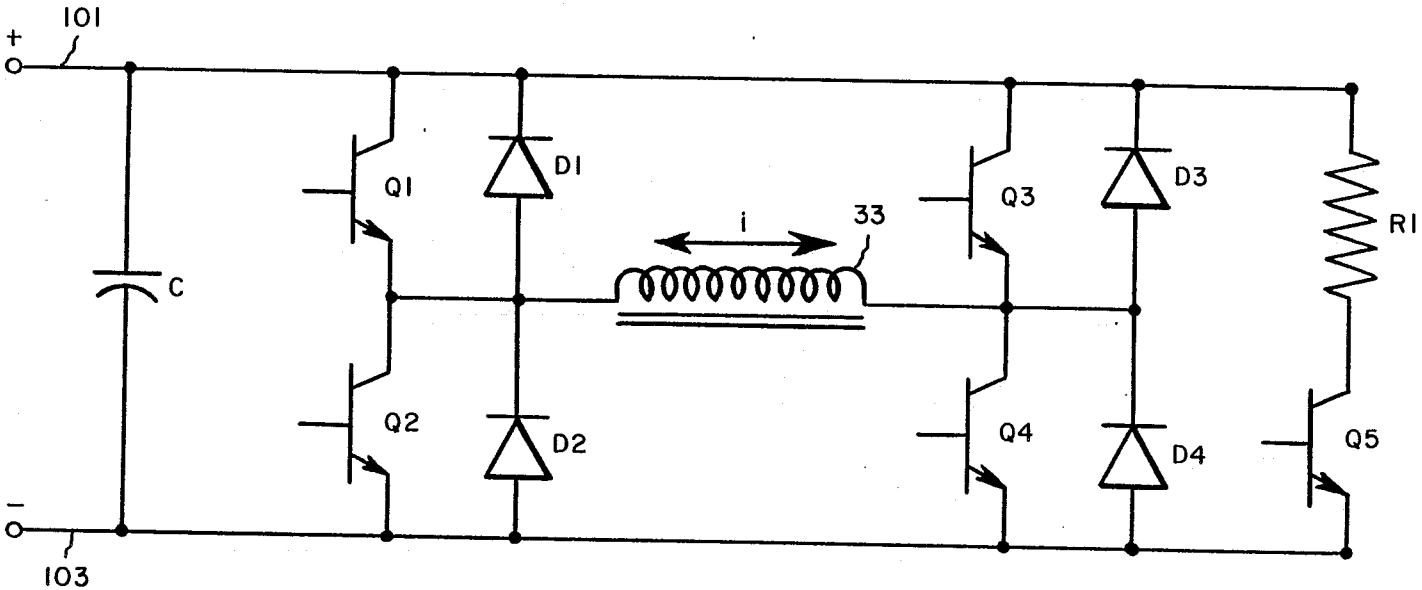
FIG. 4 shows in schematic diagram form a DC—DC reversible current power supply for energizing the resistive coil shown in FIG. 1B.

Referring now to FIG. 4, one type of power conversion circuit which can be used is a reversible current DC—DC chopper which has four controlled semiconductors Q1, Q2, Q3, and Q4 with four feedback diodes D1, D2, D3, and D4. A DC power source (not shown) is connected to positive and negative rails, 101 and 103, respectively. The controlled semiconductors are shown as NPN bipolar transistors. The transistors are connected in pairs Q1 and Q2, and Q3 and Q4 in series between the rails. Each of the feedback diodes D1, D2, D3, and D4 is connected across a respective transistor Q1, Q2, Q3, and Q4, with the anode of the diode connected to emitter of the transistor and the cathode of the diode connected to collector of the transistor.

The resistive plunger coil 33 is connected between the pairs series connected transistors. A dynamic braking chopper comprises a controlled semiconductor switch Q5 comprising an NPN transistor, in series with a resistor R connected between the rails. A filter capacitor C is connected across the rails. The bases of the transistors are connected to a control circuit (not shown).

An optical sensor having a sending unit 97*a* and a receiving unit 97*b* are shown (not to scale) in FIG. 1 in recesses in the bore of the vacuum vessel for determining when the resistive coil passes a predetermined point in the bore of the magnet by sensing when the light traveling from the sending unit 97*a* is interrupted and therefore no longer received at receiving unit 97*b*.

Current is supplied in a first direction when Q1 and Q4 are conducting. Current is supplied in the opposite direction when Q2 and Q3 are conducting. The current in resistive coil is controlled by sensing the current supplied to the coil such as by using a Hall type feedback device connected to a control circuit (not shown) which controls the transistor switching. When the resistive coil operates without a current reversal during the ejection stroke and the plunger return stroke is at lower speed, the current rating of the semiconductors (Q1 and Q4 or Q2 and Q3) can be reduced. The DC power to the rails can be provided by batteries which allow for regeneration when the coil energy is returned to the battery. DC power can alternatively be provided by rectifying AC power using a 12 pulse rectifier to reduce the harmonic content in the AC lines. If an AC supply is used, the regenerative energy can be stored in the capacitor C. The dynamic braking chopper comprising resistor R and transistor Q5 control the rise in DC voltage during regeneration.

Figure 5:
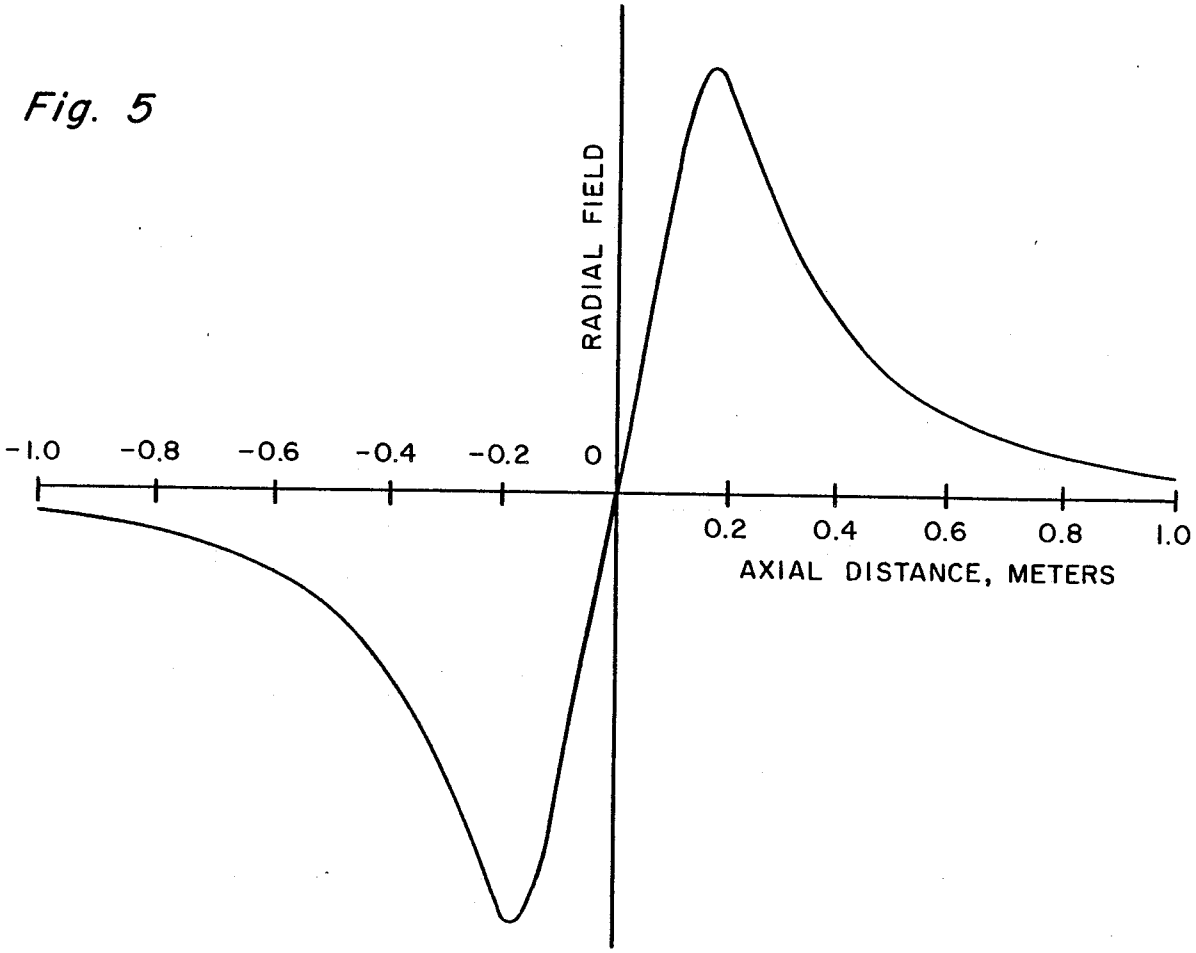
FIG. 5 shows a graph of the radial magnetic field component measured in the center of the winding, along the lines A—A shown in FIG. 1, as a function of position measured along the axial midplane of the superconductive magnet.

In operation, the superconductive coil 11 provides the main field which remains constant. Motion of the resistive coil 33 is controlled by controlling the magnitude and direction of the current in the resistive coil, since two current carrying coils can be made to attract or repel one another by the appropriate choice of current direction in each. The propulsion force on the moving coil results from the interaction of the moving coil current with the radial field component of the stationary coil. The radial field seen along an axial line A—A passing through one side of the resistive winding is shown in FIG.5. The field of the superconducting coil decreases as the third power of the axial distance from the coil. Since it is the radial component of the stationary field that produces the force on the resistive coil and therefore the plunger, it is to be expected that the energy extracted per unit distance of travel of the plunger will decrease accordingly. It can be shown, in general, where both the stationary and moving coils are of similar size, about 95% of available energy to be obtained by moving two coils apart is extracted by moving the coils apart a distance comparable to half the radius of the stationary coil. The simplest launch configuration would involve having the moving coil starting its traverse from a position of maximum repulsive force adjacent to the stationary coil and moving away under the influence of that force. The stroke length would be about equal to the radius of the stationary coil, since most of the energy has by then been imparted to the plunger.

As can be seen in FIG. 5, the radial field of the stationary field extends in both directions but reverses direction at the axial midpoint of the coil. To extract twice the energy from the main field the movable coil stroke could be doubled with the movable coil moving from one axial side of the stationary coil through the coil and then to the opposite axial side. To maintain the driving force on the movable coil in the same direction when it passes by the stationary coil it is necessary to switch the direction of current flow in the movable coil when the radial field component reverses. The current flow direction in the stationary coil remains unchanged. The optical sensor 97*a* and b is used to determine the plunger position. The optical sensor position is selected to allow sufficient time for the current in the resistive coil to reverse so that when the axial midpoint of the resistive coil passes the axial midpoint of the superconducting coil, the current has been reversed but not before.

The work produced as a function of the distance the resistive coil moves centered about the axial midplane of the superconducting coil has been calculated and is shown in the table below. The current in the resistive coil is assumed to change direction when the axial midpoint of the resistive coil passes the axial midpoint of the superconducting coil.

TABLE 2

Work Produced as a Function of the Coil Distance Moved

| Distance Coil Moves Energized (meters) | Work Produced (joules) |
|---|---|
| 2.0 | 360,000 |
| 2.4 | 373,000 |
| 3.0 | 383,000 |

Movement of the resistive coil in a first axial direction causes the sliding seal in tube 15 to force the water in the tube against the torpedo ejecting the torpedo. Moving the resistive coil in the opposite direction repositions the piston for another shot.

Figure 6:
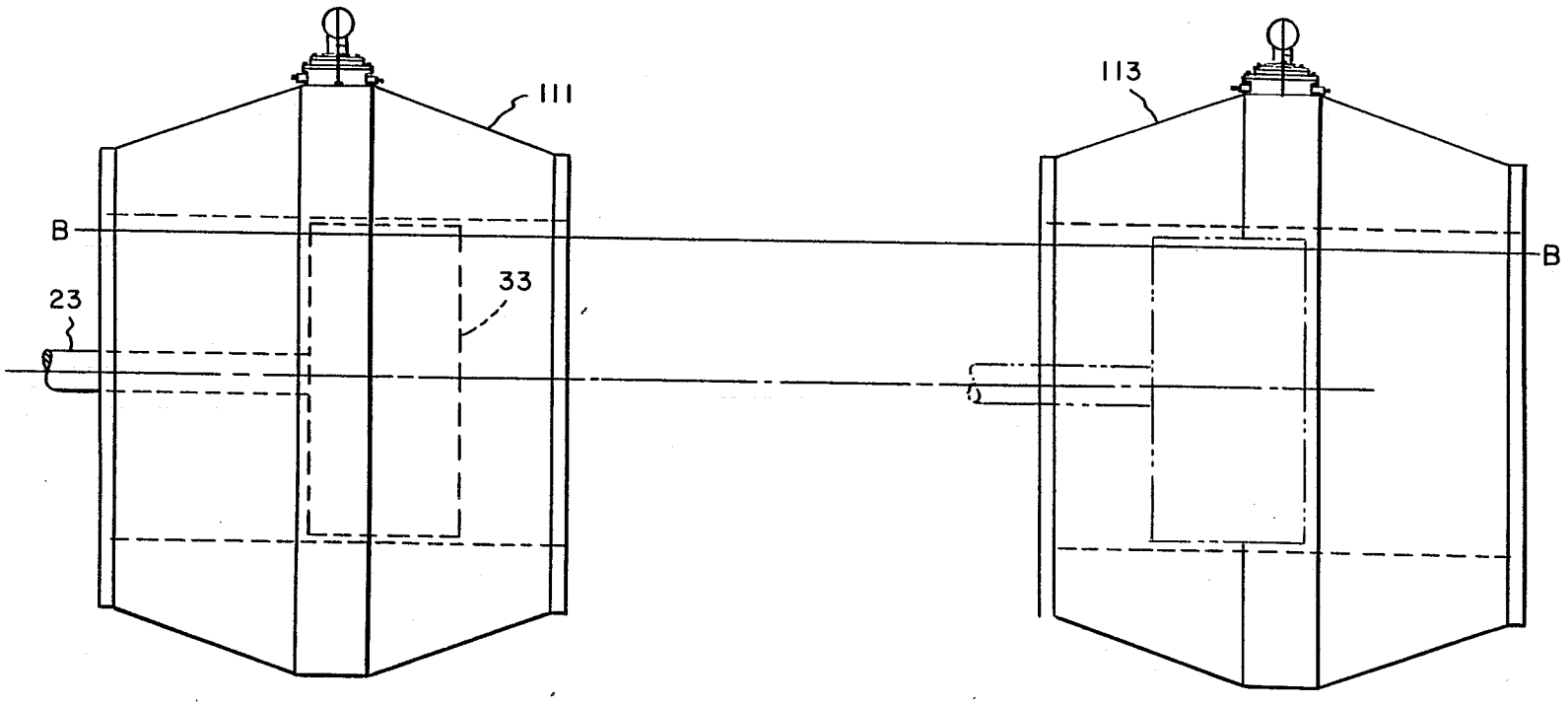
FIG. 6 shows a side view of two stationary superconductive magnets and a resistive coil situated at the end of a plunger in accordance with another embodiment of the present invention.
Figure 7:
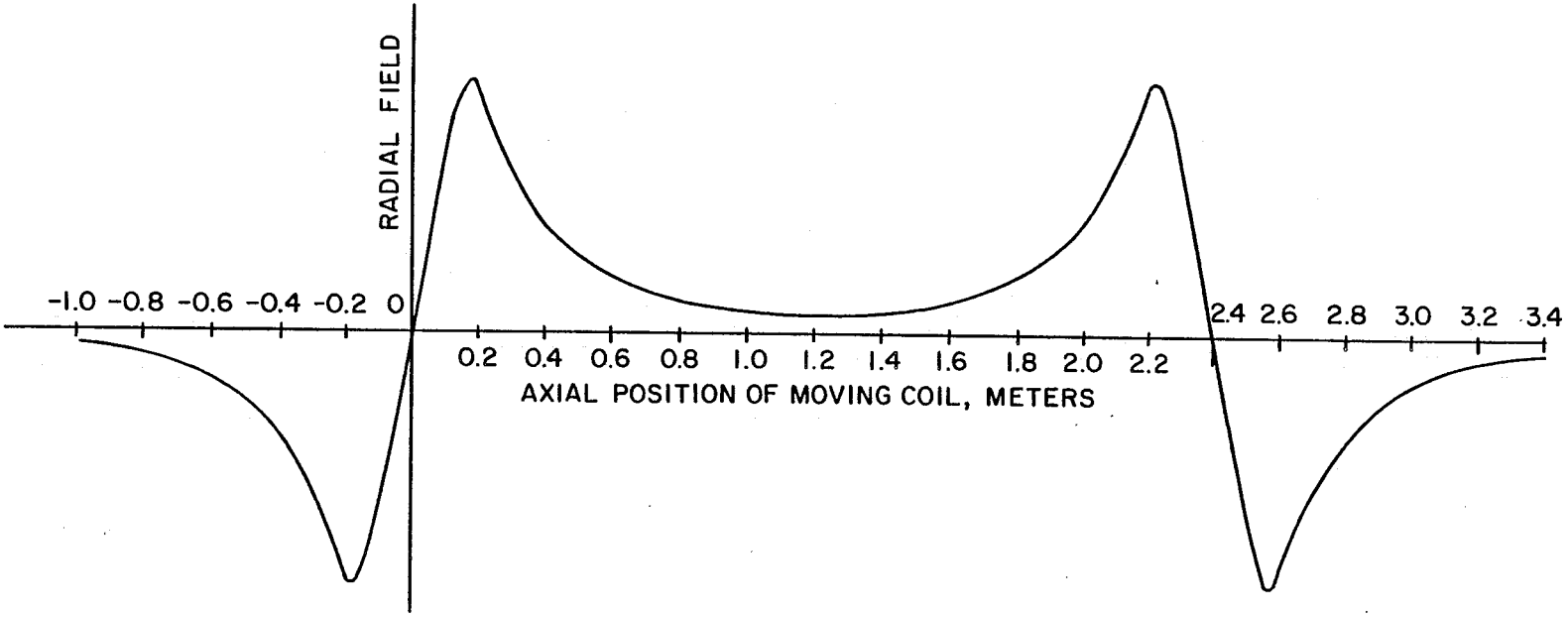
FIG. 7 shows a graph of the radial magnetic field measured component in a portion of the resistive coil, along the line B—B shown in FIG. 6, as a function of the resistive coil position, with the 0 and 2.4 meter location on the abscissa indicating the axial midplane position of each of the superconducting magnets, respectively.
Figure 8A:
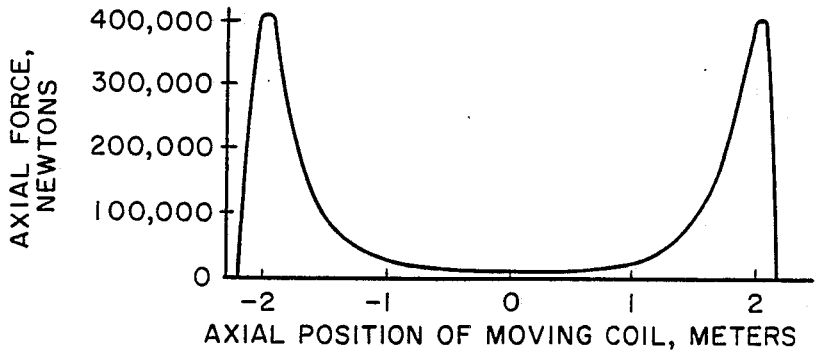
FIGS. 8A, B, and C are graphs showing the axial force on a resistive coil as a function of the coil's position between superconductive coils spaced axially apart 4.4, 2.4, and 1.4 meters on center, respectively.
Figure 8B:
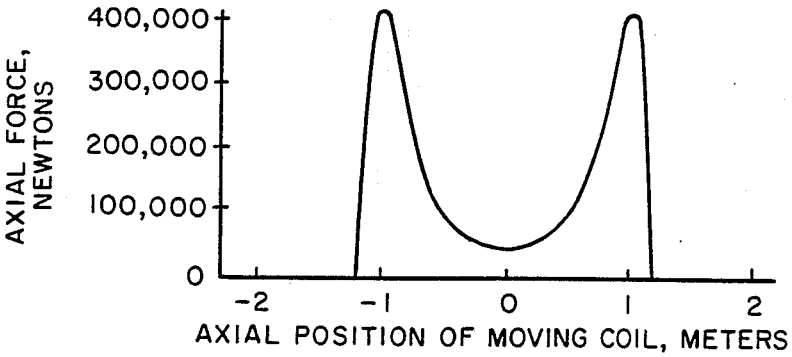
Figure 8C:
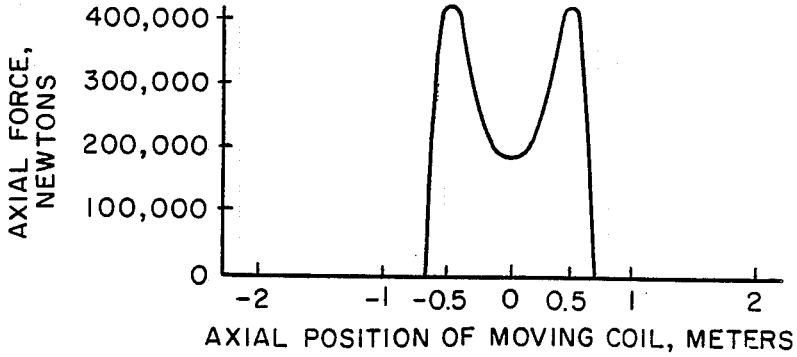

Another embodiment of the present invention having two superconductive magnets 111 and 113 is shown in FIG.6. Each magnet comprises a superconductive coil in its own vacuum vessel of the type shown in FIG. 1. The two magnets are arranged coaxially and axially spaced from one another. Each of the superconductive coils has current flowing in opposite directions. The superconductive magnets produce radial fields measured along line B—B which are additive in the region between them as shown in FIG.7. The amount of work which can be extracted from this system, ignoring losses, is obtained by integrating the force of the moving coil over the distance between the superconducting coils. The profile of the axial direction force is shown FIGS. 8A, B, C for different superconducting coil separations. The total work extracted with the two superconducting coils at different separations with the energized resistive coil moving between them is shown in the table below. The resistive coil begins its travel in a position to the right of the axial midpoint of the coil shown by the hidden lines and completes its travel at a position shown by the phantom outline in magnet 113 to the left of the axial midpoint of the coil. The direction of current flow in the resistive coil does not change during its travel.

As shown in Table 3, the 2.4 meter distance between the superconducting coils with a 2.2 meter stroke of the resistive coil centered about the midplane between the two coils is almost as effective as the 4.4 meter spacing and 4.2 meter stroke but results in a more compact launcher. The 2.2 meter ejection stroke does not require a current reversal. Twice as much energy could be extracted with a stroke twice as long centered about the axial midplane between the superconductive coils. The longer stroke would require a current reversal in the resistive coil when the axial center of the resistive coil passed the axial center of each of the superconductive coils. A sensor of the type shown in FIG. 1 could be used to determine the resistive coil position.

TABLE 3

Effect of Coil Separation Distance on Work Produced

| Distance Between Superconducting Coil Centers (m) | Distance Resistive Coil Moves Energized (m) | Work Produced (joules) |
|---|---|---|
| 4.4 | 4.2 | 375,800 |
| 2.4 | 2.2 | 371,600 |
| 1.4 | 1.2 | 355,000 |

While the superconductive coils have been shown in a passively shielded vacuum vessel, active shielding could alternatively be used.

The foregoing has described an electromagnetic launcher which is quiet, has high reliability and minimum maintenance requirements.

While the invention has been particularly shown and described with reference to several embodiments thereof, it will be understood by those skilled in the art that various changes in form and detail may be made without departing from the spirit and scope of the invention.

What we claim is:

1. An electromagnetic launcher, comprising:

a stationary superconductive coil situated coaxially in a cylindrical vacuum vessel for providing a magnetic field, said superconductive coil having a central aperture, the vacuum vessel having an axially extending bore passing through the central aperture of the superconducting coil;

a resistive coil situated coaxially with said superconductive coil and movable axially relative to said stationary superconductive coil, the outer diameter of said resistive coil being smaller than the inner diameter of said bore permitting said resistive coil to pass therethrough;

launch activating means coupled to said resistive coil, said launch activating means comprising a shaft joined at one end to said resistive coil, a tube open at both ends, a sliding piston situated in said tube and connected to the other end of said shaft; and power supply means coupled to said resistive coil for providing current of a desired direction and magnitude, so that energization of the resistive coil in the presence of the radial field component of the magnetic field of the superconductive coil creates an axial force on said movable coil, the direction and magnitude of which is dependent on the direction and magnitude of the current in said resistive coil.

* * * * *